US008879075B2

(12) United States Patent
Kitajima

(10) Patent No.: US 8,879,075 B2
(45) Date of Patent: Nov. 4, 2014

(54) SETTING APPARATUS, INSPECTION SYSTEM, SETTING METHOD OF INSPECTION PROCESSING, AND PROGRAM

(75) Inventor: Keisuke Kitajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 13/519,847

(22) PCT Filed: Mar. 27, 2012

(86) PCT No.: PCT/JP2012/002095

§ 371 (c)(1),
(2), (4) Date: Jun. 28, 2012

(87) PCT Pub. No.: WO2012/132399

PCT Pub. Date: Oct. 4, 2012

(65) Prior Publication Data

US 2013/0016382 A1 Jan. 17, 2013

(30) Foreign Application Priority Data

Mar. 30, 2011 (JP) ..... 2011-075376

(51) Int. Cl.

| | |
|---|---|
| ***G06F 3/12*** | (2006.01) |
| ***G06K 15/02*** | (2006.01) |
| ***G06F 15/00*** | (2006.01) |
| ***G06K 1/00*** | (2006.01) |
| ***G03G 15/01*** | (2006.01) |
| ***G03G 15/00*** | (2006.01) |

(52) U.S. Cl.

CPC ..... *G03G 15/502* (2013.01); *G03G 2215/0158* (2013.01); *G03G 2215/0125* (2013.01); *G03G 15/0189* (2013.01); *G03G 2215/00586* (2013.01); *G03G 2215/00561* (2013.01)

USPC ..... 358/1.13; 358/1.11; 358/1.15; 358/1.9

(58) Field of Classification Search

None

See application file for complete search history.

(56) References Cited

U.S. PATENT DOCUMENTS

| | | | | |
|---|---|---|---|---|
| 7,570,788 | B2 * | 8/2009 | Tsukamoto et al. | 382/112 |
| 7,855,808 | B2 * | 12/2010 | Murakami | 358/1.9 |
| 7,903,284 | B2 * | 3/2011 | Kadota | 358/1.9 |
| 8,132,509 | B2 * | 3/2012 | Sugiyama et al. | 101/483 |
| 8,488,199 | B2 * | 7/2013 | Kawamoto | 358/3.06 |
| 2004/0061884 | A1 * | 4/2004 | Yamaguchi | 358/1.9 |
| 2007/0139703 | A1 * | 6/2007 | Shimamura et al. | 358/1.15 |
| 2009/0128850 | A1 | 5/2009 | Oshima | |
| 2010/0097624 | A1 * | 4/2010 | Hirakawa | 358/1.12 |
| 2013/0136314 | A1 * | 5/2013 | Yamakawa | 382/112 |
| 2013/0321517 | A1 * | 12/2013 | Kubota | 347/19 |

FOREIGN PATENT DOCUMENTS

| | | | |
|---|---|---|---|
| JP | 05-254105 | A | 10/1993 |
| JP | 06-160298 | A | 6/1994 |
| JP | 11-039492 | A | 2/1999 |
| JP | 2007-148027 | A | 6/2007 |
| JP | 2012-25064 | A | 2/2012 |

* cited by examiner

*Primary Examiner* — Satwant Singh

(74) *Attorney, Agent, or Firm* — Canon U.S.A., Inc. IP Division

(57) ABSTRACT

A setting apparatus of the present invention is useful in simplifying user operation necessary in setting an inspection item necessary in setting a target of inspection processing of a printed product. For example, if a two-sided printing is set by the user, a setting of print misregistration inspection for inspecting print misregistration between the front side and the back side is allowed to the user, however, if a one-sided printing is set by the user, a setting of print misregistration inspection is not allowed to the user.

17 Claims, 15 Drawing Sheets

SETTING APPARATUS, INSPECTION SYSTEM, SETTING METHOD OF INSPECTION PROCESSING, AND PROGRAM

TECHNICAL FIELD

The present invention relates to a setting apparatus, an inspection system, a setting method of inspection processing, and a program.

BACKGROUND ART

Conventionally, there are inspection apparatuses and inspection methods useful for determining a printing failure of a printed product.

For example, Japanese Patent Application Laid-Open No. 11-039492 discusses an apparatus which reads an image printed on a sheet by a sensor, compares the image read by the sensor with an original image input to the printer when the printing is performed, and determines whether the printed image has been printed appropriately. Further, Japanese Patent Application Laid-Open No. 05-254105 discusses an inspection method useful for inspecting misregistration of print images printed on two sides of a sheet by using a mark printed on the two sides. Furthermore, Japanese Patent Application Laid-Open No. 06-160298 discusses an inspection method useful for determining a printing failure by converting a RGB signal obtained by a sensor reading a printed product, into a Lab color space and comparing a color difference value in the Lab color space with a predetermined threshold value.

As discussed in Japanese Patent Applications Laid-Open Nos. 11-039492, 05-254105, and 06-160298, many inspection items for inspection processing are used in determining printing failures. They are, for example, inspection items used for the inspection of a print position, tint, and character portion. Since the inspection each user performs is different depending on the user, it is useful if the user can make a setting regarding whether to perform the inspection for each inspection item.

However, if the user makes the setting for each inspection item, it takes much time. Further, time is necessary when searching for a desired inspection item from many inspection items.

CITATION LIST

Patent Literature

PTL 1: Japanese Patent Application Laid-Open No. 11-039492

PTL 2: Japanese Patent Application Laid-Open No. 05-254105

PTL 3: Japanese Patent Application Laid-Open No. 06-160298

SUMMARY OF INVENTION

The present invention is directed to a method useful for simplifying user operations necessary in setting an inspection item in the processing for inspecting a printed product.

According to an aspect of the present invention, a setting apparatus performing a setting of inspection processing for inspecting a printed product which has undergone print processing includes a display unit configured to display a print setting screen for making a print setting in the print processing and a control unit configured to, if a particular print setting is made on the print setting screen, set an item corresponding to the particular print setting as a target of the inspection processing.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DESCRIPTION OF EMBODIMENTS

Various exemplary embodiments, features, and aspects of the invention will be described in detail below with reference to the drawings.

Exemplary embodiments described below shall not be construed as limiting the present invention and, further, not all of the combinations of the features described in the exemplary embodiments are essential to the present invention.

Figure 1:
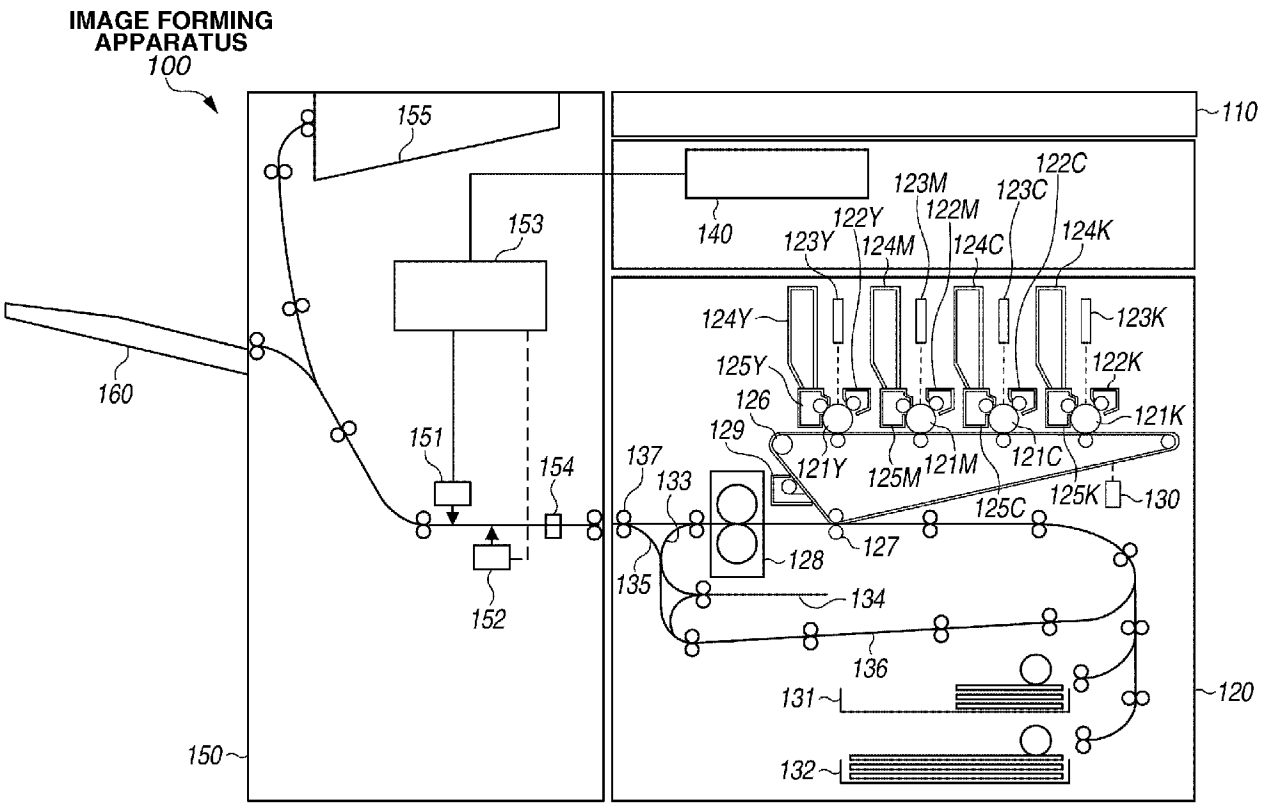
FIG. 1 illustrates a configuration of an image forming apparatus according to the present invention.

FIG. 1 illustrates a configuration of an image forming apparatus 100 according to a first exemplary embodiment of the present invention.

The image forming apparatus 100 includes an operation unit 110, a printer unit 120, a controller unit 140, an inspection unit 150, and a discharge tray 160. The image forming apparatus 100 can print an image on a sheet and inspect the obtained printed product.

When the image forming apparatus 100 performs printing on a sheet, the controller unit 140 (described in detail below with reference to FIG. 2) transmits cyan, magenta, yellow, and black (CMYK) color signals to exposure control units 123C, 123M, 123Y, and 123K, respectively. Then, each of the exposure control units outputs a laser light that corresponds to the color signal it has received.

When the laser light is directed on each of photosensitive drums 121C, 121M, 121Y, and 121K, which have been charged by charging devices 122C, 122M, 122Y, and 122K, an electrostatic latent image is formed on each of the photosensitive drums. Each photosensitive drum rotates counterclockwise by a motor (not illustrated). The latent image formed on the photosensitive drum is developed by a corresponding developer out of developers 125C, 125M, 125Y, and 125K. The developers are connected to toner cartridges 124C, 124M, 124Y, and 124K. Thus, toner is continuously supplied to the developers as a recording material in the print processing.

An intermediate transfer member 126 contacts the photosensitive drums and rotates clockwise in accordance with the rotation of the photosensitive drums. When the photosensitive drum rotates, a toner image which has been developed is transferred to the intermediate transfer member 126. The toner image transferred to the intermediate transfer member 126 is further transferred to a sheet conveyed from a cassette 131 or a cassette 132 by a transfer roller 127. Further, a cleaning unit 129, which cleans the toner that remains on the intermediate transfer member 126 after the transfer of the image by the transfer roller 127, is provided at a subsequent stage. Furthermore, a density sensor 130, which measures a density of the toner image on the intermediate transfer member 126, is provided in the image forming apparatus.

The sheet onto which the toner image is transferred is conveyed to a fixing portion 128. At the fixing portion 128, the toner image is fixed by a built-in heater and a pressure roller.

The sheet that passed through the fixing portion 128 is temporarily conveyed from a path 133 to a path 134 by a flapper (not shown). After the trailing edge of the sheet passes the path 133, the sheet is switch-backed and conveyed to a path 135 and to a discharge roller 137. In this manner, the sheet is discharged from the printer unit 120 by the rotation of the discharge roller 137. The image-transferred side of the sheet is face down when it is discharged.

Further, if two-sided printing is performed, the sheet is conveyed from the fixing portion 128 to the path 133 and to the path 134. Then, immediately after the trailing edge of the sheet passes the path 133, the sheet is switch-backed and conveyed to a two-sided conveying path 136 by a flapper (not shown). Subsequently, a toner image is transferred again to the sheet conveyed to the two-sided conveying path 136 by the transfer roller 127. This toner image is also fixed to the sheet at the fixing portion 128.

The sheet discharged from the discharge roller 137 is conveyed to the inspection unit 150. At the inspection unit 150, a reading unit 151 and a reading unit 152 read the image printed on the sheet and generate image data. The inspection unit 150 includes a sheet detection unit 154 which detects the sheet. The inspection unit 150 controls the reading timing of the image printed on the sheet according to the timing the sheet detection unit 154 has detected the sheet.

The image data which has been read is transmitted to an inspection control unit 153 (described below in detail with reference to FIG. 3). Various types of inspection processing are performed at the inspection control unit 153. If the sheet passes the inspection, the sheet is discharged on the discharge tray 160. If the sheet does not pass the inspection, the sheet is discharged on a NG tray 155.

Figure 2:
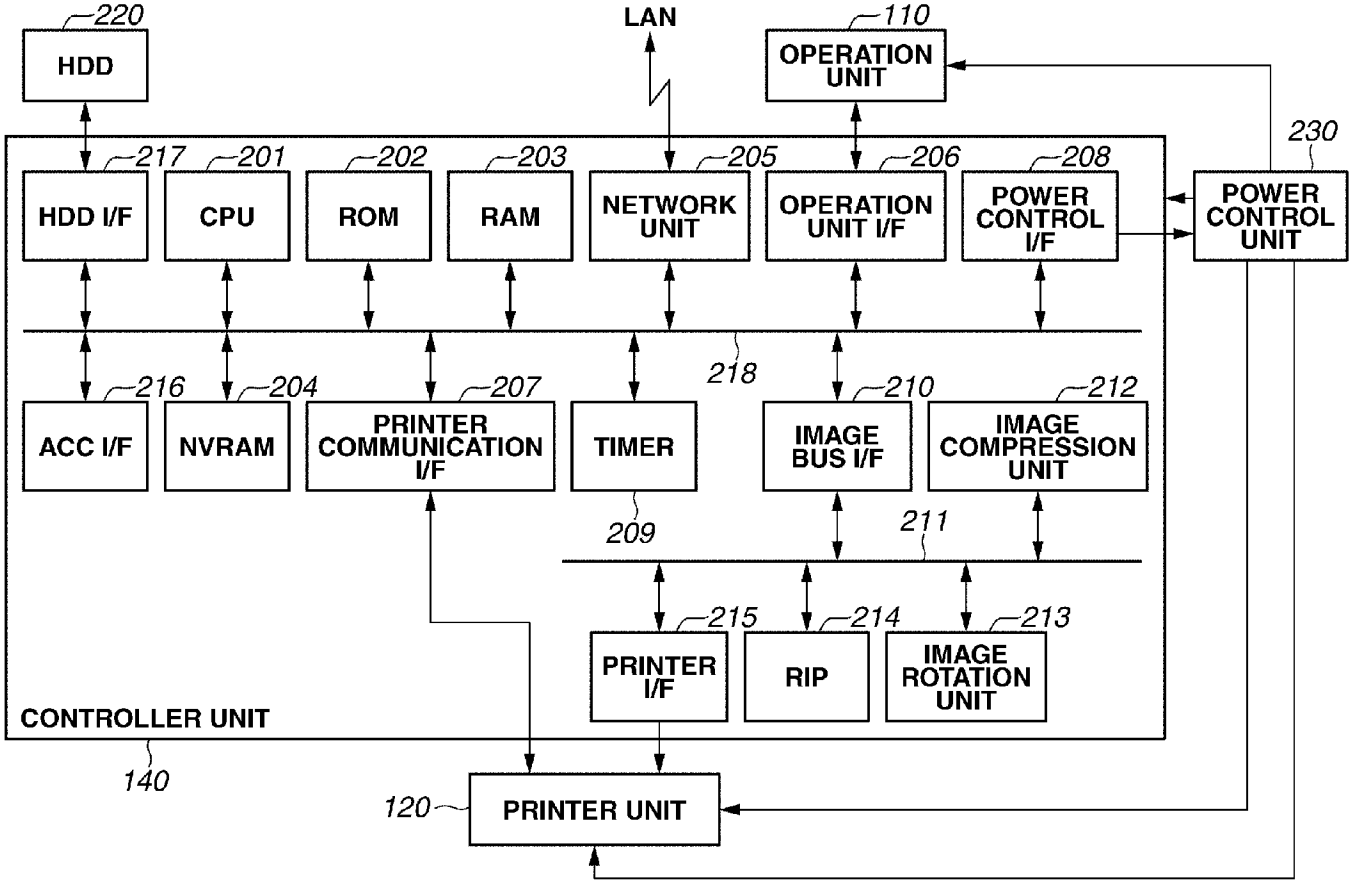
FIG. 2 illustrates a configuration of a controller unit according to the present invention.

FIG. 2 illustrates an inner configuration of the controller unit 140.

A central processing unit (CPU) 201 performs overall control of the controller unit 140. The CPU 201 reads out a control program stored in a read-only memory (ROM) 202 or a hard disk drive (HDD) 220 and controls the controller unit 140. The ROM 202 stores programs used by the CPU 201. A random access memory (RAM) 203 is used as a main memory and a temporary storage area such as a work area of the CPU 201.

A non-volatile RAM (NVRAM) 204 stores control parameters. A network unit 205 performs communication control. For example, the network unit 205 controls transmission/reception of electronic mails and input/output of page description language (PDL) data with a host apparatus (described below with reference to FIG. 13) via a local area network (LAN). The HDD 220 stores programs used by the CPU 201 as is the case with the ROM 202.

An operation unit I/F 206 is an interface used for the communication between the controller unit 140 and the operation unit 110. A printer communication I/F 207 is an interface used for the communication between the controller unit 140 and the printer unit 120. A power control I/F 208 is an interface used for the communication between the controller unit 140 and a power control unit 230.

An ACC I/F 216 is an interface used for the communication between the controller unit 140 and the inspection unit 150. A HDD I/F 217 is an interface used for the communication between the controller unit 140 and the HDD 220. A timer 209 is used for keeping the current time and monitoring whether the time which has been set has elapsed. Each of the above-described units communicates with one another via a system bus 218.

An image Bus I/F 210 connects an image bus 211 which transfers image signals and the system bus 218. An image compression unit 212, an image rotation unit 213, a raster image processor (RIP) unit 214, and a printer I/F 215 are connected to the image bus 211.

The image compression unit 212 performs compression/decompression processing of image data in, for example, Joint Photographic Experts Group (JPEG) format. The image rotation unit 213 rotates the image data. The RIP unit 214 rasterizes the PDL data. The printer I/F 215 corrects the image data to be output and printed on a sheet. For example, the printer I/F 215 performs resolution conversion and transmits the print data to the printer unit 120.

Figure 3:
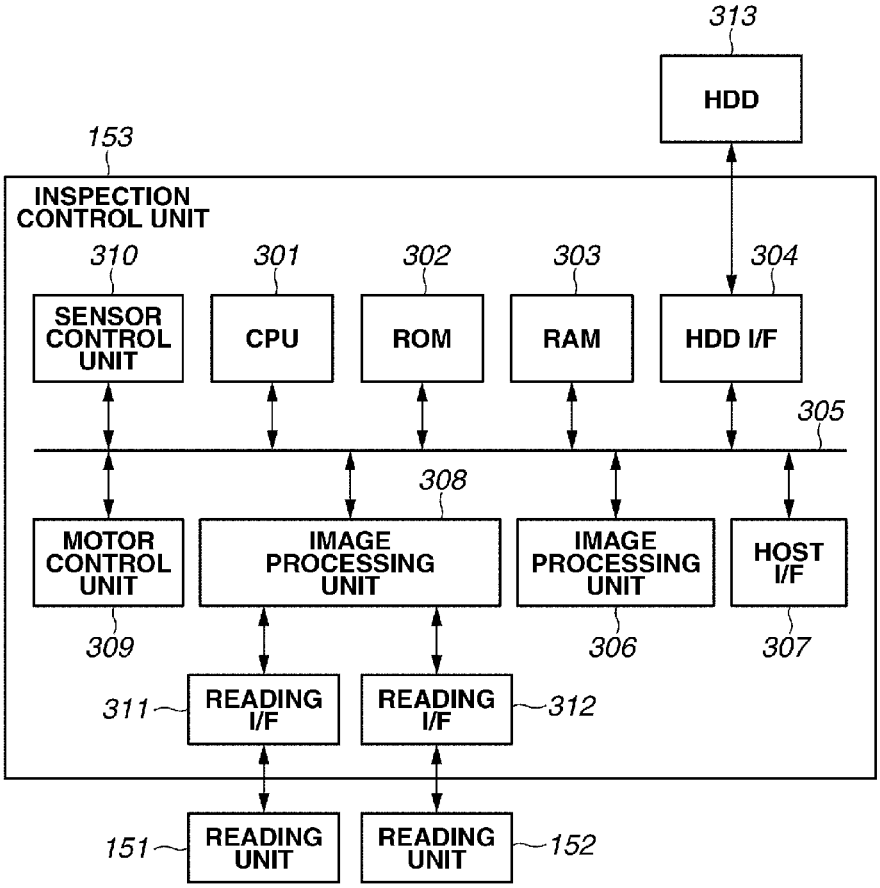
FIG. 3 illustrates a configuration of an inspection control unit according to the present invention.

FIG. 3 illustrates an inner configuration of the inspection control unit 153 in the inspection unit 150.

A CPU 301 performs overall control of the inspection unit 150. The CPU 301 read outs a control program stored in a ROM 302 or a HDD 313 and controls the inspection unit 150. Programs used for the operation performed by the CPU 301 are stored in the ROM 302. Further, image data which is printed on a sheet by the printer unit 120 is stored in the ROM 302.

A RAM 303 is used as a main memory and a temporary storage area such as a work area of the CPU 301. A program used by the CPU 301 and image data printed on a sheet by the printer unit 120 are stored in the HDD 313 as is the case with the ROM 302. A HDD I/F 304 is used for the communication between the inspection control unit 153 and the HDD 313.

A reading I/F 311 performs communication between the inspection control unit 153 and the reading unit 151. A reading I/F 312 performs communication between the inspection control unit 153 and the reading unit 152. The reading I/F 311 controls the reading unit 151 and receives image data read by the reading unit 151. The reading I/F 312 controls the reading unit 152 and receives image data obtained read by the reading unit 152. The reading unit 151 reads the front side of the sheet and the reading unit 152 reads the back side of the sheet. Each of the reading unit 151 and the reading unit 152 includes a sensor array. The sensor arrays are arranged in such a manner that images on the entire area of the conveyed sheet can be read by the sensor arrays.

A read image processing unit 308 performs processing such as variable magnification processing and gamma correction processing on the image data sent from the reading units 151 and 152, and transmits the processed data to the RAM 303. A motor control unit 309 controls various motors in the inspection unit 150. A sensor control unit 310 detects the state of the various sensors in the inspection unit 150 and notifies the CPU 301 of the detection result. A HOST I/F 307 is used for communication between the inspection control unit 153 and the ACC I/F 216 of the controller unit 140. The HOST I/F 307 performs transmission/reception of print setting and image data.

An image processing unit 306 executes inspection processing of a printed product by comparing the image data (image data for printing) stored in the ROM 302 or the HDD 313 and the image data obtained by the reading of the reading unit 151 or the reading unit 152. Each of the above-described units communicates with one another via a system bus 305.

According to the present embodiment, three types of inspection processing, which are print misregistration inspection, color inspection, and character inspection, are executable. The print misregistration inspection is used for inspecting whether there is print misregistration between the front side (first side) and the back side (second side). The color inspection is used for inspecting whether the image is printed with an appropriate tint or density. The character inspection is used for inspecting whether text information has been correctly printed. The inspection processing according to the present embodiment is not limited to the print misregistration inspection, the color inspection, and the character inspection, and the present embodiment can be applied to other inspection processing.

Regarding the print misregistration inspection, first, a distance from a reading start position to a reference point is acquired for both the front side and the back side of the sheet. Then, if the difference between the distance of the front side and the distance of the back side is greater than a predetermined threshold value, it is determined that print misregistration has occurred and the sheet is discharged on the NG tray 155.

Regarding the color inspection, first a region is designated as the target of the color inspection. Next, a mean value of each RGB color of the designated region of image data read by the reading unit 151 (the reading unit 152 if the side to be inspected is the back side) and the designated region of the image data for printing is calculated. Then, a difference between the two mean values is calculated. This difference indicates the color difference. If the color difference is greater than a predetermined threshold value set in advance, it is determined that the image is not printed with the appropriate tint according to the color inspection, and the sheet is discharged on the NG tray 155.

The above-described determination is made based on the assumption that a color image is printed on a sheet. If inspection of a monochromatic image is to be performed, a mean value of the density of a designated region is obtained in place of the mean value of each RGB color. Then, the difference (density difference) between two mean values is calculated and compared with a threshold value set in advance as the color inspection.

Regarding the character inspection, optical character recognition (OCR) processing is applied to the image data obtained by the reading of the reading unit 151 or the reading unit 152 and whether an appropriate character is printed in the inspection target region is determined. When the character inspection is performed, text information in PDL data is compared with text information obtained by the reading of the sheet according to the OCR processing. If it is determined that appropriate character is not printed on the sheet by the character inspection, the sheet is discharged on the NG tray 155.

Figure 13:
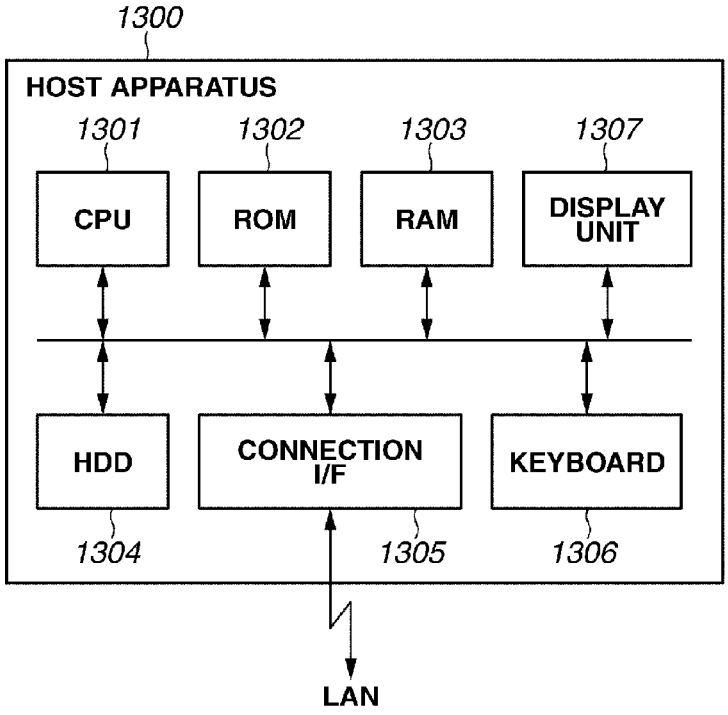
FIG. 13 illustrates a configuration of a host apparatus according to the present invention.

FIG. 13 illustrates a configuration of a host apparatus 1300. The host apparatus is, for example, a personal computer (PC) operated by the user.

A CPU 1301 performs overall control of the host apparatus 1300. The CPU 1301 reads out a control program stored in a ROM 1302 or a HDD 1304 and controls the host apparatus 1300. The ROM 1302 stores programs used by the CPU 1301. A RAM 1303 is used as a main memory and a temporary storage area such as a work area of the CPU 1301. Although programs used by the CPU 1301 are stored in the ROM 1302, they are also stored in the HDD 1304.

A connection I/F 1305 connects the host apparatus 1300 and the LAN. The host apparatus 1300 communicates with the image forming apparatus 100 via a network. A keyboard 1306 is used for inputting information to the host apparatus 1300. Various screens are displayed on a display unit 1307.

By installing a printer driver in the host apparatus 1300, print processing and inspection processing executed by the image forming apparatus 100 can be controlled by the host apparatus 1300. When the processing is controlled by the host apparatus, a setting screen used for setting the print processing or the inspection processing is displayed on the display unit 1307. A print job is transmitted to the image forming apparatus 100 based on the setting made on the setting screen.

Figure 4:
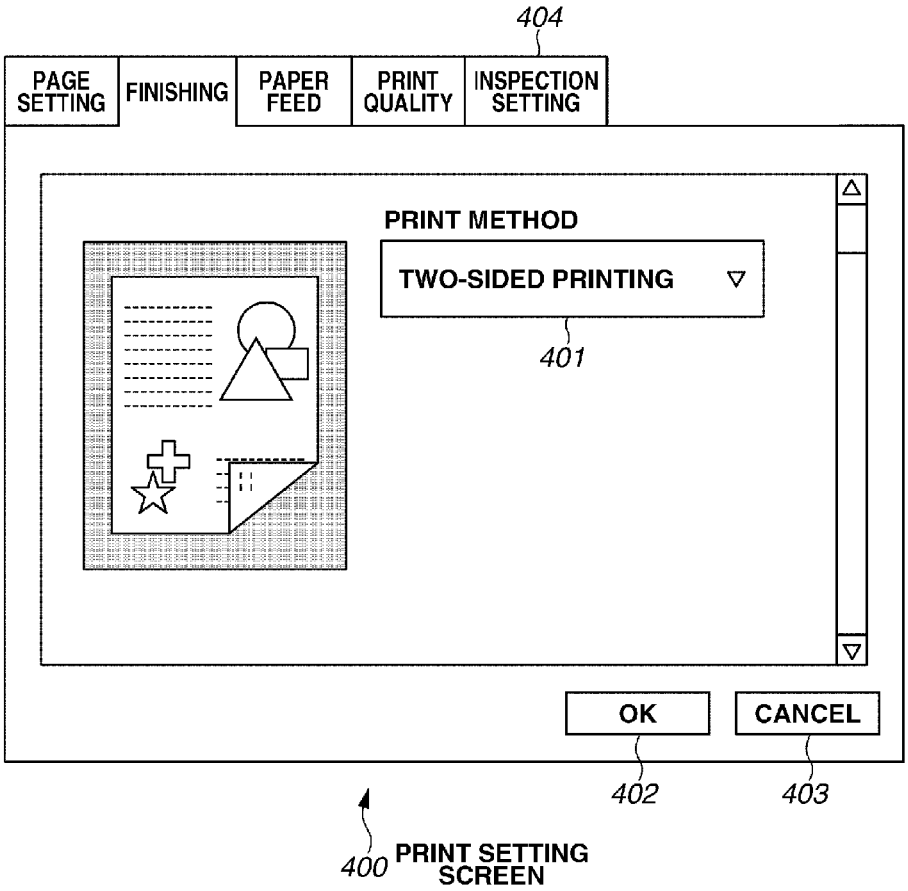
FIG. 4 illustrates a print setting screen according to a first exemplary embodiment of the present invention.

FIG. 4 illustrates a print setting screen 400 used for making the print setting.

The print setting screen 400 is displayed on the display unit 1307 when the printer driver, which has been installed in the host apparatus 1300, is executed. The user can select printing methods such as "one-sided printing" and "two-sided printing" from a pull-down menu 401 displayed on the print setting screen 400.

By selecting either of the printing methods, the user determines whether to perform printing on one side or both sides of a sheet. After then, if the user selects an OK key 402, the print setting is made and the job is transmitted to the image forming apparatus 100. On the other hand, if the user selects a cancel key 403, the display of the print setting screen 400 ends.

If the user selects an inspection setting tab 404, an inspection setting screen used for setting the inspection processing of the printed product is displayed. This inspection setting screen will be described in detail below with reference to FIG. 5A.

Figure 5A:
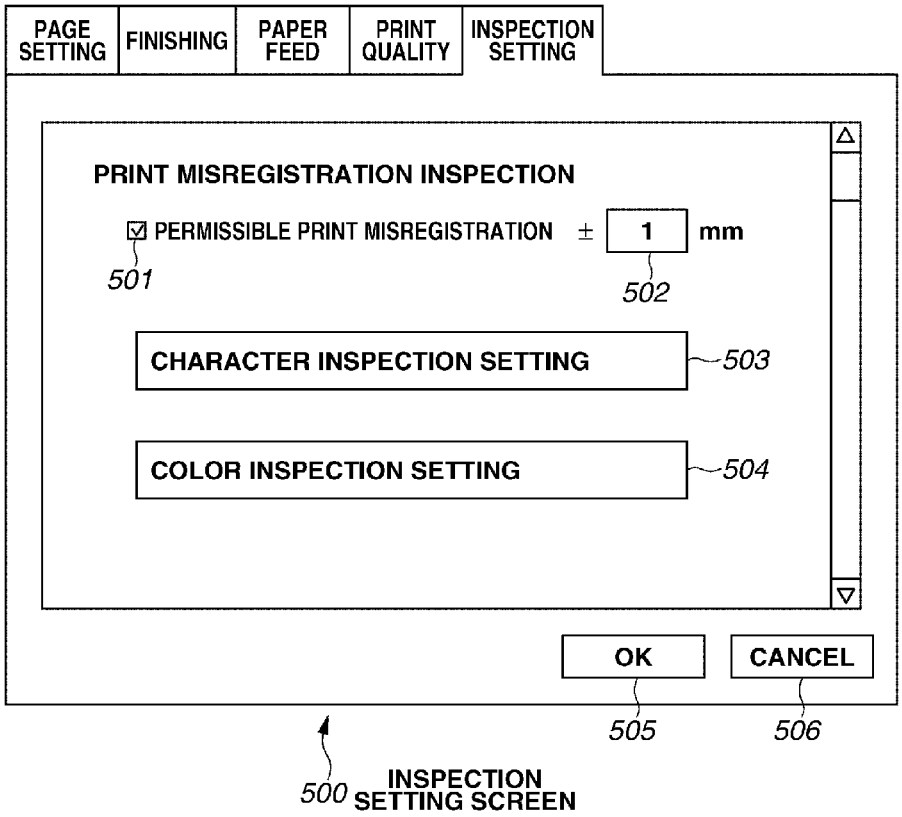
FIG. 5A illustrates an inspection setting screen according to the first exemplary embodiment.

FIG. 5A illustrates the inspection setting screen used for setting the inspection processing.

An inspection setting screen 500 is displayed when the inspection setting tab 404 on the print setting screen 400 is selected by the user. The inspection setting screen 500 is displayed on the display unit 1307 when the printer driver, which has been installed in the host apparatus 1300, is executed as is the case with the print setting screen 400. According to the present embodiment, three inspection items, which are the above-described print misregistration inspection, character inspection, and color inspection, can be set.

If the user selects a key 503, a setting screen used for setting the character inspection setting is displayed. If the user selects a key 504, a setting screen used for setting the color inspection is displayed. Further, if the user desires to perform the print misregistration inspection, the user clicks a check box 501. Additionally, by inputting a permissible value of print misregistration between the front side and the back side of the sheet in a permissible value field 502, an accuracy level of the print misregistration inspection can be set.

If the user selects an OK key 505, the inspection setting is set. Then, the inspection setting is transmitted to the image forming apparatus 100 together with the print setting as a job. Further, if the user selects a cancel key 506, the display of the inspection setting screen 500 ends.

Figure 5B:
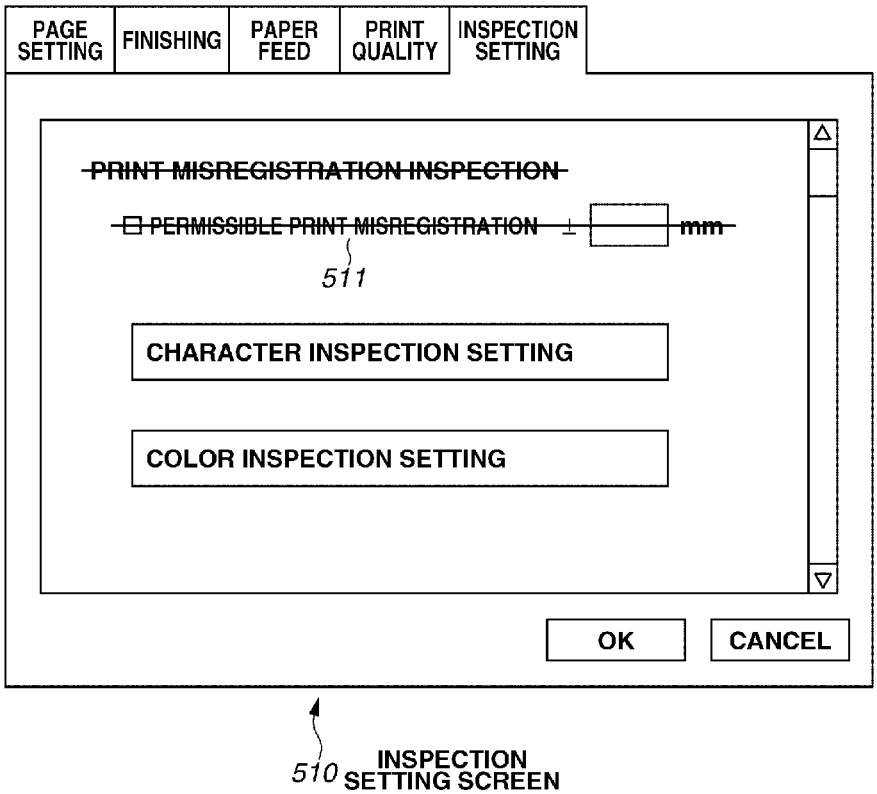
FIG. 5B illustrates an inspection setting screen according to the first exemplary embodiment.

As described above, the user can respectively make the setting for each inspection item via the inspection setting screen 500. However, since the print misregistration inspection is effective only when the two-sided printing is selected, it is useless for a user who performs one-sided printing. A screen considering this point is an inspection setting screen 510 illustrated in FIG. 5B.

The inspection setting screen 510 is displayed when the user selects one-sided printing on the print setting screen 400. The difference between the inspection setting screen 500 and the inspection setting screen 510 is that the setting of the print misregistration inspection is disabled on the inspection setting screen 510. The setting of the print misregistration inspection on the inspection setting screen 510 is disabled by a strikethrough 511. Thus, the user is unable to make the setting for the print misregistration inspection.

Accordingly, it will be clear for the user who performs one-sided printing that the print misregistration inspection is unnecessary. Further, the screen is helpful in avoiding useless setting of unnecessary print misregistration inspection. If two-sided printing is selected by the user via the print setting screen 400, the inspection setting screen 500 is displayed.

Although the setting of the print misregistration inspection is disabled by the strikethrough 511 on the inspection setting screen 510, the method for disabling the setting of the present embodiment is not limited to such a method. For example, the inspection item of the print misregistration inspection can be grayed out so that the setting of the print misregistration inspection cannot be set or the inspection item of the print misregistration inspection can be hidden.

Further, a warning message can be displayed on the inspection setting screen 510 if the user selects the print misregistration inspection. In this case, the execution of the print misregistration inspection is enabled if the user makes the setting of the print misregistration inspection after confirming the warning message. According to this method, whether an image is printed at the correct position on the sheet when one-sided printing is performed can be determined.

Although the present embodiment has been described using one-sided printing and two-sided printing, the present embodiment can be applied to any print setting if printing on both sides or one side of a sheet is determined by the setting.

Next, the flowchart illustrated in FIG. 6 will be described.

Figure 6:
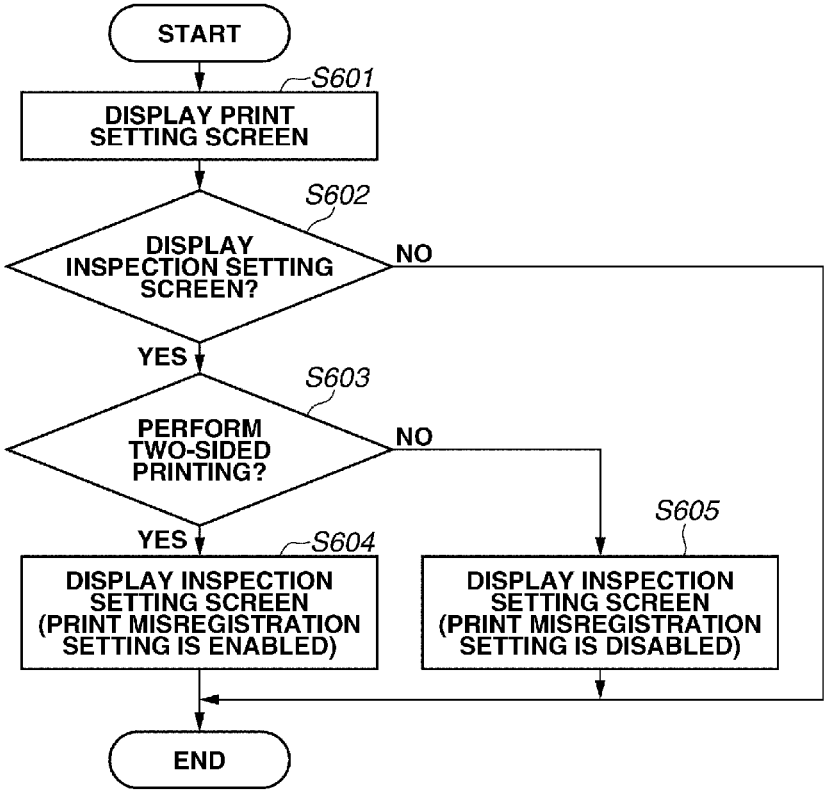
FIG. 6 is a flowchart illustrating display control procedures of the print setting screen and the inspection setting screen according to the first exemplary embodiment.

The flowchart in FIG. 6 illustrates a display control of the print setting screen and the inspection setting screen according to the present embodiment. Each step from steps S601 to S605 is processed by the CPU 1301 executing the printer driver installed in the host apparatus 1300.

In step S601, the display unit 1307 of the host apparatus 1300 displays the print setting screen. The print setting screen which is displayed is, for example, the print setting screen 400 in FIG. 4.

In step S602, the CPU 1301 determines whether the inspection setting screen is to be displayed. If the user selects the inspection setting tab 404, the CPU 1301 determines that the inspection setting screen is to be displayed (YES in step S602), and the processing proceeds to step S603. On the other hand, if the user does not select the inspection setting tab 404 and selects the OK key 402 or the cancel key 403, the CPU 1301 determines that the inspection setting screen is not to be displayed (NO in step S602), and the processing ends.

In step S603, the CPU 1301 determines whether the printing is to be performed on both sides of the sheet based on the print setting set on the print setting screen 400. For example, if the user selects two-sided printing on the print setting screen 400, the CPU 1301 determines that the printing is to be performed on both sides of the sheet (YES in step S603), and the processing proceeds to step S604. In step S604, the display unit 1307 displays the inspection setting screen. The print misregistration inspection setting is enabled on this screen. An example of this inspection setting screen displayed is the inspection setting screen 500 illustrated in FIG. 5A.

On the other hand, for example, if the user selects one-sided printing on the print setting screen 400, the CPU 1301 determines that it is not necessary to perform printing on both sides of the sheet (NO in step S603), and the processing proceeds to step S605. In step S605, the display unit 1307 displays the inspection setting screen. The print misregistration inspection setting is disabled on this screen. An example of this inspection setting screen displayed is the inspection setting screen 510 illustrated in FIG. 5B.

If one-sided printing is set as default and is displayed on the print setting screen 400 and, further, if the default setting is not changed by the user, in step S603, the host apparatus determines that printing on both sides of the sheet is not necessary.

As described above, according to the present embodiment, an inspection setting screen disabling or enabling the setting of the print misregistration inspection is displayed depending on whether the printing is to be performed on both sides or one side of a sheet. Thus, the necessary inspection item becomes clearer for the user. Further, since this display is helpful in avoiding useless setting of unnecessary print misregistration inspection items, user operation necessary for the setting of the inspection items can be simplified.

According to the present embodiment, although the setting of the print misregistration inspection is disabled if one-sided printing is selected by the user as the inspection setting screen 510 shows, the setting of the print misregistration inspection itself can be enabled and only disabled at timing when the user executes the print misregistration inspection (e.g., selects the OK key). Further, a message that explains the reason why the setting of the print misregistration inspection has been disabled or why the execution of the print misregistration inspection has been disabled can be displayed on the screen.

Print misregistration inspection has been described in detail according to the first exemplary embodiment. The present invention, however, is not limited to the above-described system. According to a second exemplary embodiment, an example of a different embodiment of the present invention will be described. Since the configurations of the image forming apparatus in the second exemplary embodiment are similar to those of the image forming apparatus in the first exemplary embodiment, their descriptions are not repeated.

Figure 7:
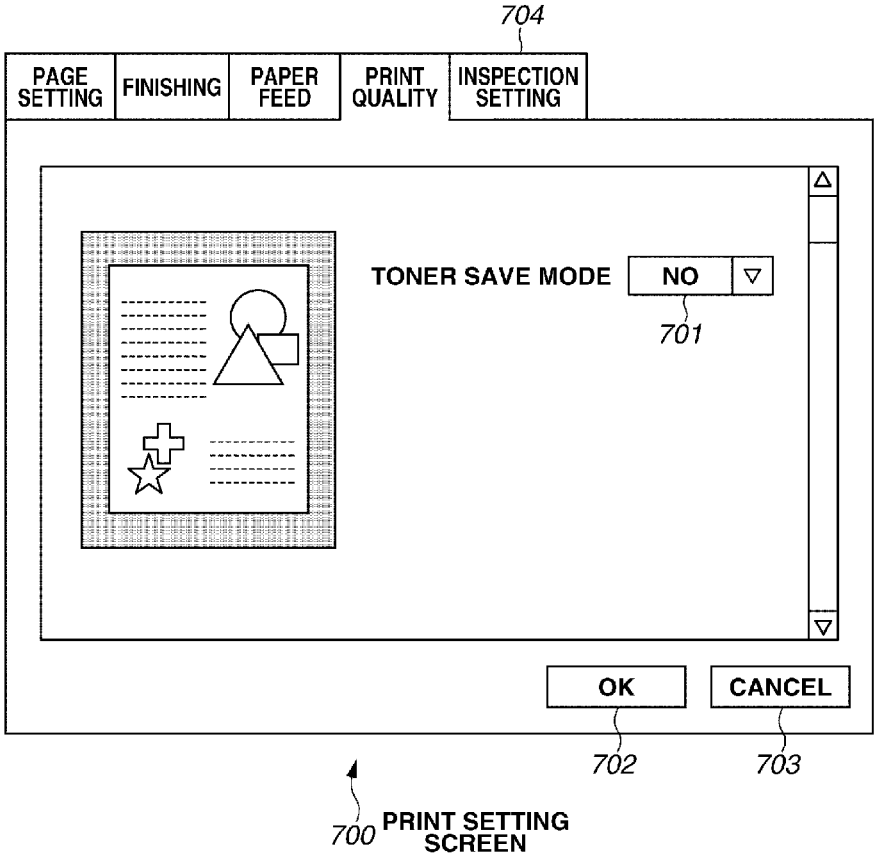
FIG. 7 illustrates the print setting screen according to a second exemplary embodiment of the present invention.

FIG. 7 illustrates a print setting screen 700 used for making the print setting.

The print setting screen 700 is displayed when the printer driver, which has been installed in the host apparatus 1300, is executed. The user can select whether to use a toner-saving mode from a pull-down menu 701 on the print setting screen 700. By using the toner-saving mode (second print mode), the use amount of toner can be reduced compared to when the normal printing (first print mode) is performed. However, if the toner-saving mode is used, the print image may be faded or light-colored due to the reduced amount of toner.

If the user selects the OK key 402, the print setting is set, and a job is transmitted to the image forming apparatus 100. On the other hand, if the user selects the cancel key 403, the display of the print setting screen 700 ends. Further, if the user selects an inspection setting tab 704, an inspection setting screen used for the setting of the inspection processing of a printed product is displayed.

Figure 8:
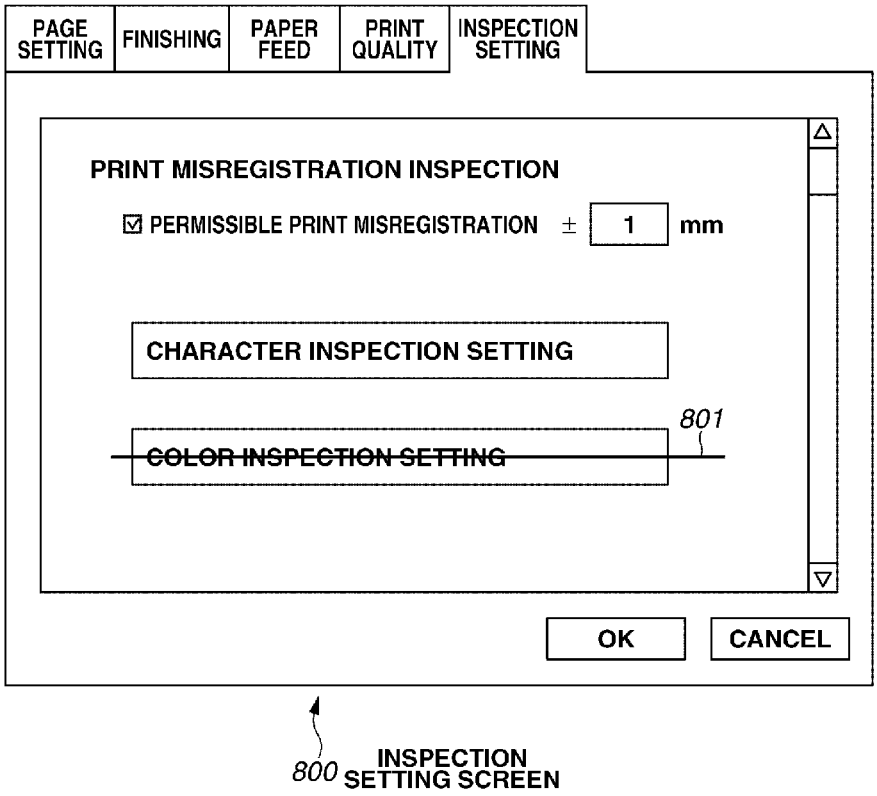
FIG. 8 illustrates the inspection setting screen according to the second exemplary embodiment.

FIG. 8 illustrates an inspection setting screen 800 which is displayed when the user selects the toner-saving mode from the pull-down menu 701 of the print setting screen 700.

On the inspection setting screen 800, the inspection items which are displayed are same as those displayed on the inspection setting screen 500 described above with reference to FIG. 5A except that the setting of the color inspection is disabled by a strikethrough 801. When printing is performed using the toner-saving mode, the obtained print image may be faded or light-colored. Thus, an image with an appropriate tint or density may not be obtained.

Considering this point, the color inspection is dealt with as an unnecessary inspection when the printing is performed using the toner-saving mode according to the present embodiment. If the user makes the selection of not using the toner-saving mode on the print setting screen 700, the inspection setting screen 500 in FIG. 5A is displayed instead of the inspection setting screen 800.

Although the setting of the color inspection is disabled by the strikethrough 801 on the inspection setting screen 800, the method for disabling the setting of the present embodiment is not limited to such a method. For example, the inspection item of the color inspection can be grayed out so that the setting of the color inspection cannot be set or the inspection item of the color inspection can be hidden.

Figure 9:
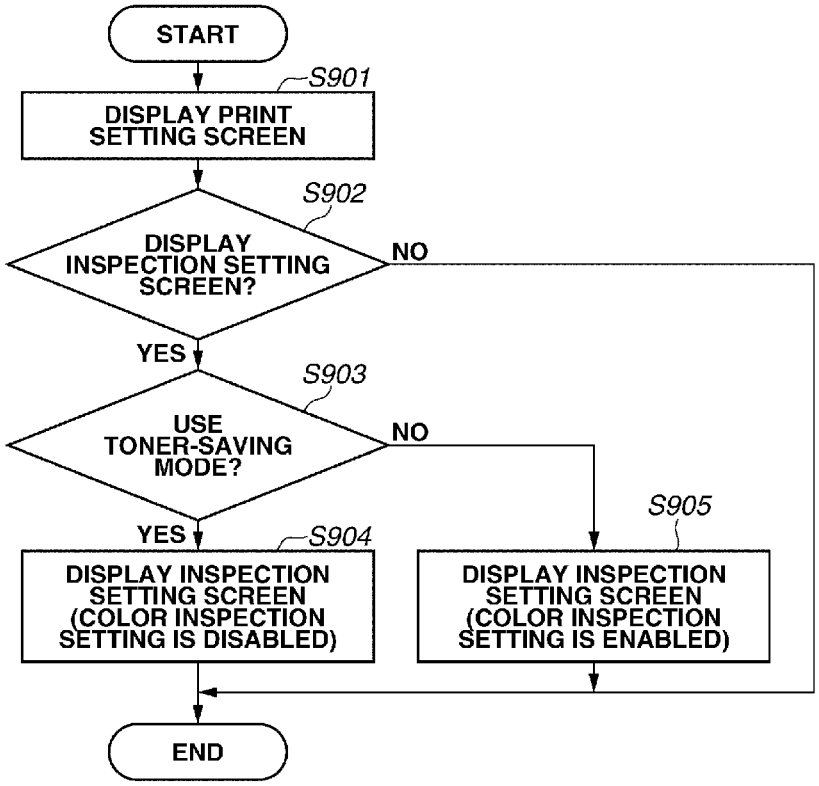
FIG. 9 is a flowchart illustrating display control procedures of the print setting screen and the inspection setting screen according to the second exemplary embodiment.

Next, the flowchart illustrated in FIG. 9 will be described. The flowchart in FIG. 9 illustrates a display control of the print setting screen and the inspection setting screen according to the present embodiment. Each step from steps S901 to S905 is processed by the CPU 1301 executing the printer driver installed in the host apparatus 1300.

In step S901, the display unit 1307 of the host apparatus 1300 displays a print setting screen. The print setting screen which is displayed is, for example, the print setting screen 700 in FIG. 7.

In step S902, the CPU 1301 determines whether the inspection setting screen is to be displayed. If the user selects the inspection setting tab 704, the CPU 1301 determines that the inspection setting screen is to be displayed (YES in step S902), and the processing proceeds to step S903. On the other hand, if the user does not select the inspection setting tab 704 and selects an OK key 702 or a cancel key 703, the CPU 1301 determines that the inspection setting screen is not to be displayed (NO in step S902), and the processing ends.

In step S903, the CPU 1301 determines whether the toner-saving mode is to be used. If the user selects the use of the toner-saving mode on the print setting screen 700 (YES in step S903), the CPU 1301 determines that the toner-saving mode is to be used and the processing proceeds to step S904. In step S904, the display unit 1307 displays the inspection setting screen. The color inspection is disabled on this screen. An example of the inspection setting screen displayed at this time is the inspection setting screen 800 illustrated in FIG. 8.

On the other hand, if the user does not select the use of the toner-saving mode on the print setting screen 700 (NO in step S903), the CPU 1301 determines that the toner-saving mode is not to be used, and the processing proceeds to step S905. In step S905, the display unit 1307 displays the inspection setting screen. The color inspection is enabled on this screen. An example of the inspection setting screen displayed at this time is the inspection setting screen 500 illustrated in FIG. 5A.

Further, if the toner-saving mode is not used as the default setting and, further, if the user does not change the default setting, then the CPU 1301 determines that the toner-saving mode is not to be used in step S903.

As described above, according to the present embodiment, an inspection setting screen disabling or enabling the setting of the color inspection is displayed depending on whether the toner-saving mode is used. Thus, the necessary inspection item becomes clearer for the user. Further, since this display is helpful in avoiding useless setting of unnecessary print misregistration inspection items, user operation necessary for the setting of the inspection items can be simplified.

According to a third exemplary embodiment, a method for simplifying input of setting items necessary in the character inspection by the user regarding the character inspection used for inspecting whether text information is correctly printed will be described. Since the configurations of the image forming apparatus in the third exemplary embodiment are similar to those of the image forming apparatus in the first exemplary embodiment, their descriptions are not repeated.

Figure 10:
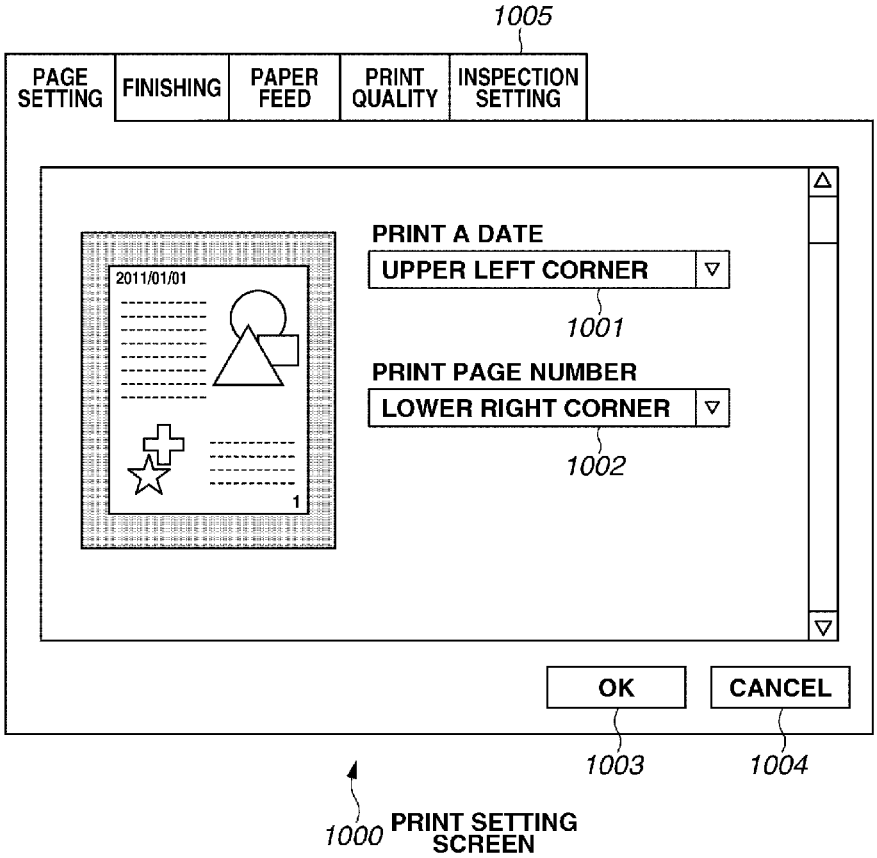
FIG. 10 illustrates the print setting screen according to a third second exemplary embodiment of the present invention.

FIG. 10 illustrates a print setting screen 1000 used for making the print setting.

The print setting screen 1000 is displayed on the display unit 1307 when the printer driver, which has been installed in the host apparatus 1300, is executed. The user can select whether to print a date by using a pull-down menu 1001 of the print setting screen 1000.

If a date is to be printed, the user can select whether to print the date on the upper left corner or the upper right corner of the sheet. However, the print area of the date is not limited to such areas. Further, if the user selects printing of the date from the pull-down menu 1001, the date the printing is performed or a date designated by the user is automatically printed on all the pages or on a designated page.

Further, the user can select whether to print a page number from a pull-down menu 1002 on the print setting screen 1000. If a page number is to be printed, the user can select whether to print the date on the lower right corner or the lower left corner of the sheet. However, the print area of the page number is not limited to such areas. Further, if the user selects printing of the page number from the pull-down menu 1002, a page number is automatically printed on all the pages or on a designated page.

If the user selects an OK key 1003, the print setting is set and the job is transmitted to the image forming apparatus 100. On the other hand, if the user selects a cancel key 1004, the display of the print setting screen 1000 ends. If the user selects an inspection setting tab 1005, an inspection setting screen used for setting the inspection processing of the printed product is displayed. The inspection setting screen which is displayed is, for example, the inspection setting screen 500 illustrated in FIG. 5A.

Figure 11A:
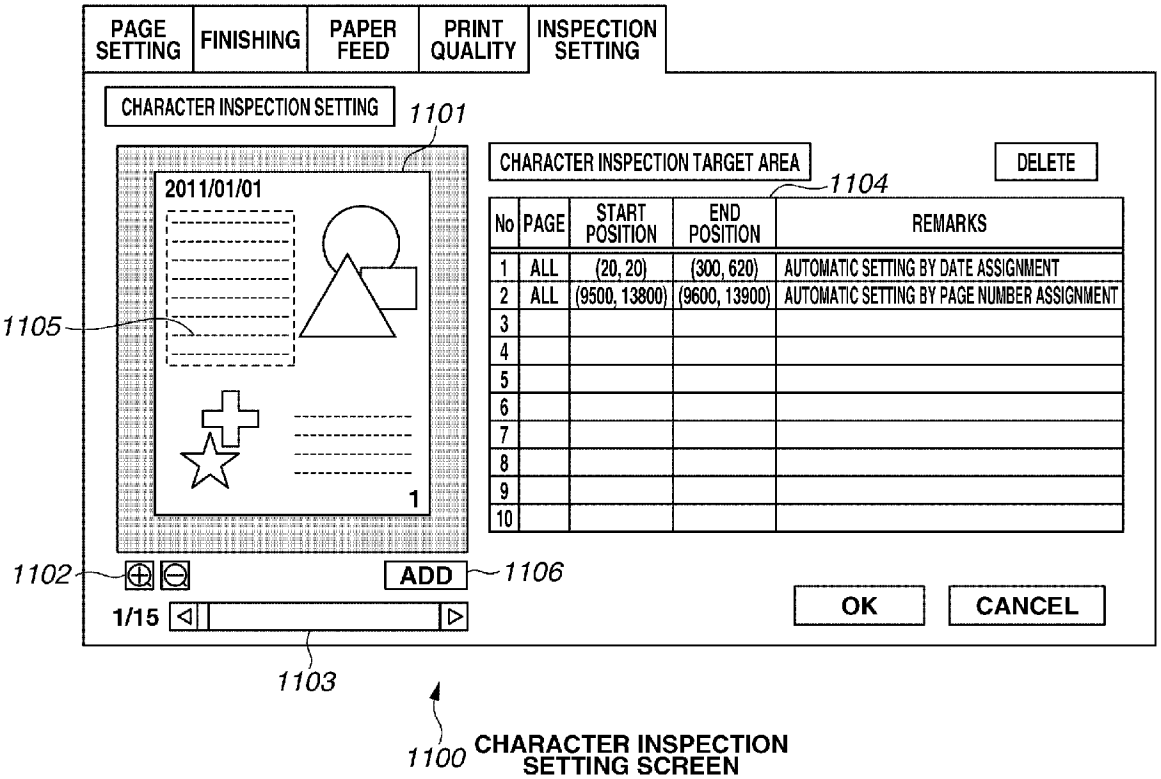
FIG. 11A illustrates a character inspection setting screen according to the third second exemplary embodiment.

If the user selects the key 503 on the inspection setting screen 500, a character inspection setting screen 1100 illustrated in FIG. 11A is displayed on the display unit 1307. The user can make the setting for the character inspection used for inspecting whether text information is correctly printed from the character inspection setting screen 1100.

An image 1101 is an example of a print image printed on a sheet. If the user selects a key 1102, the size of the image 1101 can be enlarged or reduced. If the user operates a page selection bar 1103, the print image displayed as the image 1101 can be changed to a print image corresponding to a different page. Further, items registered as the targets of the character inspection are listed in a registered item 1104 displayed on the character inspection setting screen 1100.

Next, the content of the registered item 1104 will be described in detail. "No" of the registered item 1104 is an identification number automatically set for each item. Further, "page" indicates a page number of the page included in the target of the character inspection. If "all pages" is displayed in the "page" column, the character inspection is applied to all pages. Additionally, "start position" and "end position" are information useful for identifying the region of the target in the character inspection.

The item No. 1 of the registered item 1104 is automatically registered as the target of the character inspection when the user selects printing of the date by using the pull-down menu 1001 of the print setting screen 1000. Items of "page", "start position", and "end position" are determined based on the content selected from the pull-down menu 1001.

The item No. 2 of the registered item 1104 is automatically registered as the target of the character inspection when the user selects printing of the page number by using the pull-down menu 1001 of the print setting screen 1000. Items of "page", "start position", and "end position" are determined based on the content selected from the pull-down menu 1002 as are determined regarding the item No. 1.

Figure 11B:
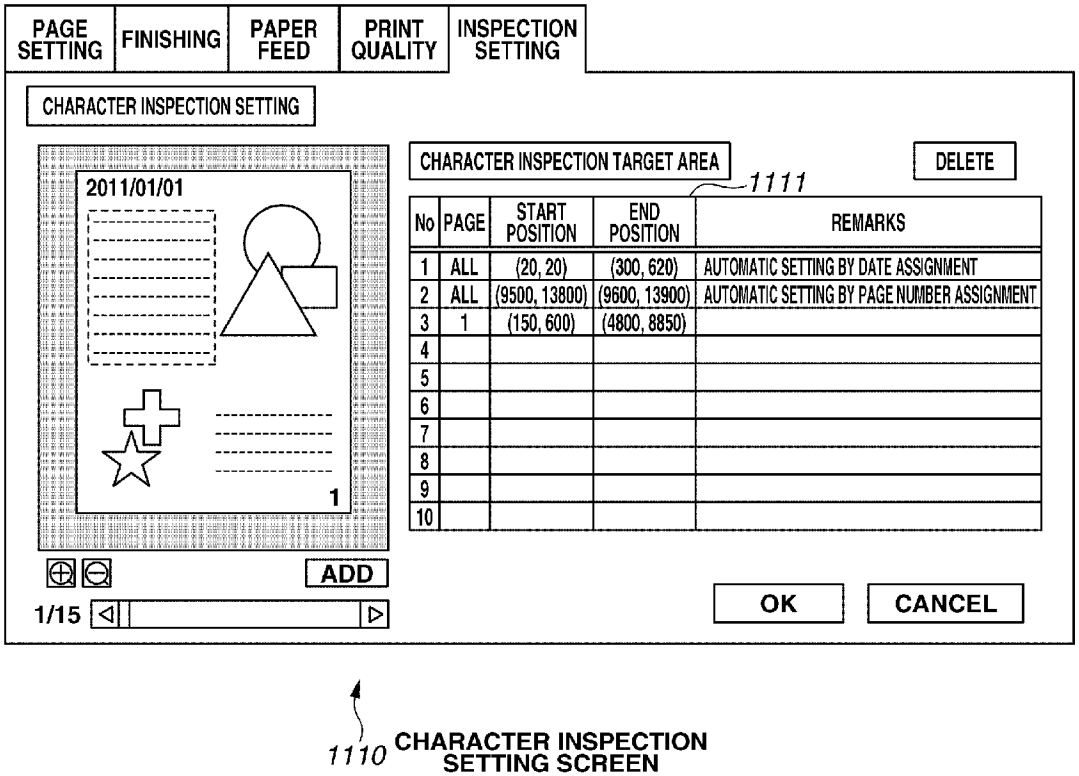
FIG. 11B illustrates a character inspection setting screen according to the third second exemplary embodiment.

If the user desires to set a certain region as a target area of the character inspection in addition to the inspection of the date and page number which have been automatically registered, the user selects a desired region (e.g., a region 1105) from the image 1101 and selects an add key 1106. Then, the selected region will be added to the registered item 1104 and a character inspection setting screen 1110 illustrated in FIG. 11B will be displayed. The region 1105 is registered as the item No. 3 of a registered item 1111 on a character inspection setting screen 1110 illustrated in FIG. 11B.

Character inspection is performed according to the content of the registered items 1104 and 1111. To be more precise, the image data read by the reading unit 151 or the reading unit 152 undergoes optical character recognition (OCR) processing. According to this processing, whether text information is appropriately printed in the inspect target region is determined.

Figure 12:
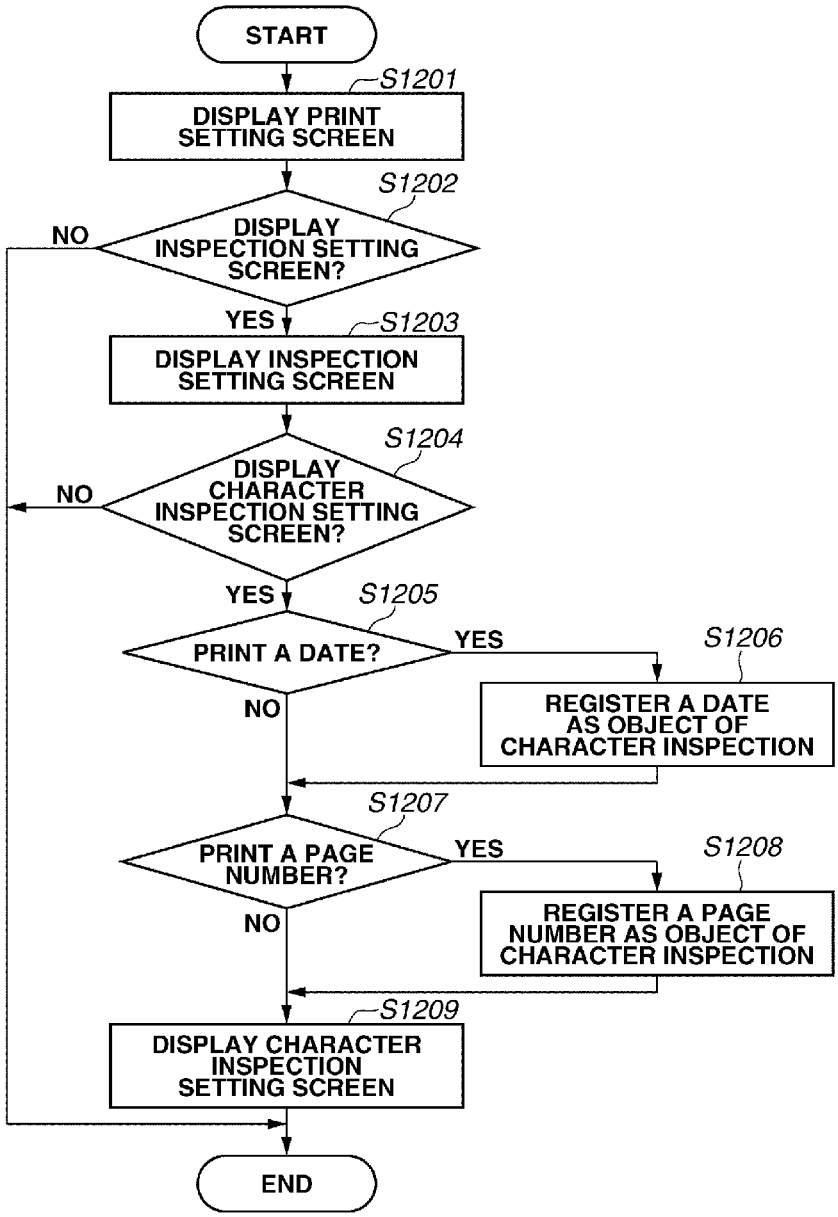
FIG. 12 is a flowchart illustrating display control procedures of the print setting screen, the inspection setting screen, and the character inspection setting screen according to the third second exemplary embodiment.

Next, the flowchart illustrated in FIG. 12 will be described. The flowchart in FIG. 12 illustrates a display control of the print setting screen, the inspection setting screen, and the character inspection setting screen according to the present embodiment. Each step from steps S1201 to S1209 is processed by the CPU 1301 executing the printer driver installed in the host apparatus 1300.

In step S1201, the display unit 1307 of the host apparatus 1300 displays a print setting screen. An example of the print setting screen which is displayed is the print setting screen 1000 in FIG. 10.

In step S1202, the CPU 1301 determines whether the inspection setting screen is to be displayed. If the user selects the inspection setting tab 1005, the CPU 1301 determines that the inspection setting screen is to be displayed (YES in step S1202), and the processing proceeds to step S1203. On the other hand, if the user does not select the inspection setting tab 1005 and selects the OK key 1003 or the cancel key 1004, the CPU 1301 determines that the inspection setting screen is not to be displayed (NO in step S1202), and the processing ends.

In step S1203, the display unit 1307 displays the inspection setting screen. The inspection setting screen which is displayed is, for example, the inspection setting screen 500 illustrated in FIG. 5A.

In step S1204, the CPU 1301 determines whether the character inspection setting screen is to be displayed. If the user selects the key 503, the CPU 1301 determines that the character inspection setting screen is to be displayed (YES in step S1204), and the processing proceeds to step S1205. On the other hand, if the user does not select the key 503, the CPU 1301 determines that the character inspection setting screen is not to be displayed (NO in step S1204), and the processing ends.

In step S1205, the CPU 1301 determines whether the date is to be printed. For example, if the user selects printing of date from the pull-down menu 1001 on the print setting screen 1000, the CPU 1301 determines that the date is to be printed (YES in step S1205), and the processing proceeds to step S1206. On the other hand, if the user does not select printing of date from the pull-down menu 1001 on the print setting screen 1000, the CPU 1301 determines that the date is not to be printed (NO in step S1205), and the processing proceeds to step S1207.

In step S1206, the CPU 1301 registers date as the target of the character inspection based on the content selected from the pull-down menu 1001.

In step S1207, the CPU 1301 determines whether the page number is to be printed. For example, if the user selects printing of page number from the pull-down menu 1002 on the print setting screen 1000, the CPU 1301 determines that the page number is to be printed (YES in step S1207), and the processing proceeds to step S1208. On the other hand, if the user does not select printing of page number from the pull-down menu 1001 on the print setting screen 1000, the CPU 1301 determines that the page number is not to be printed (NO in step S1207), and the processing proceeds to step S1209.

In step S1208, the CPU 1301 registers page number as the target of the character inspection based on the content selected from the pull-down menu 1002.

In step S1209, the display unit 1307 displays the character inspection setting screen. If date or page number is registered as the target of the character inspection in step S1206 or S1208, since date or page number is displayed on the character inspection setting screen 1100, it is automatically displayed in a registered state as the target of the character inspection in the registered item 1104. On the other hand, if date or page number is not registered as the target of the character inspection in step S1206 or S1208, it is not displayed in the registered state as the target of the character inspection in the registered item 1104.

As described above, if print setting is set so that text information such as date or page number is automatically printed according to the present embodiment, the text information can be automatically registered as the target of character inspection used for determining whether the text information is correctly printed. Thus, the user does not need to register the text information as a target of the character inspection.

Other Embodiments

According to the above-described exemplary embodiments, processing has been performed by the user operating the host apparatus 1300 in which the printer driver has been installed. However, the user can make the print setting and the inspection setting by using a setting screen displayed on the operation unit 110 of the image forming apparatus 100. In this case, the host apparatus 1300 in which the printer driver is installed or the image forming apparatus 100 will be the setting apparatus that performs the setting of the inspection processing.

Further, although the print setting screen and the inspection setting screen are displayed as different screens in the above-described exemplary embodiments, the content of the print setting screen and the inspection setting screen can be displayed on a same screen.

Further, the above-described exemplary embodiments can also be achieved by supplying a software program that realizes each function of the aforementioned exemplary embodiments to a system or an apparatus via a network or various types of storage media, and a computer (or a CPU or a MPU) in the system or the apparatus reads and executes the program stored in such storage media.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-075376 filed Mar. 30, 2011, which is hereby incorporated by reference herein in its entirety.

The invention claimed is:

1. A setting apparatus performing a setting of inspection processing for inspecting a printed product on which has been performed print processing, the apparatus comprising:

a display unit configured to display a print setting screen for setting a print setting in the print processing and an inspection setting screen configured to set an inspection setting in the inspection processing, and a control unit configured to control, if a particular print setting is set on the print setting screen, the display unit such that the inspection setting screen is displayed in a state where an item corresponding to the particular print setting is registered as a target of the inspection processing.

2. The setting apparatus according to claim 1, wherein the particular print setting is print setting used for printing particular text information on a sheet, and wherein the item corresponding to the particular print setting is the particular text information printed on the sheet.

3. The setting apparatus according to claim 2, wherein the particular text information is information of a page number.

4. The setting apparatus according to claim 2, wherein the particular text information is information of a date.

5. The setting apparatus according to claim 1, wherein the display unit displays a setting screen which includes a plurality of tabs including at least a first tab and a second tab, the print setting screen is displayed in the first tab, and the inspection setting screen is displayed in the second tab.

6. A setting apparatus performing a setting of inspection processing for inspecting a printed product on which has been performed print processing, the apparatus comprising:

a display unit configured to display a print setting screen for setting a print setting in the print processing and an inspection setting screen for setting an inspection setting in the inspection processing; and a control unit configured to perform control, if a particular print setting is set on the print setting screen, so that a user is permitted to set a particular inspection setting corresponding to the particular print setting on the inspection setting screen, and perform control, if the particular print setting is not set on the print setting screen, so that the user is not permitted to set the particular inspection setting on the inspection setting screen.

7. The setting apparatus according to claim 6, wherein the particular print setting is a setting for performing printing on both sides of a sheet, and wherein the particular inspection setting corresponding to the particular print setting is a setting for comparing an image printed on a first side of a sheet with an image printed on a second side of the sheet and inspecting presence of print misregistration between the first side and the second side.

8. The setting apparatus according to claim 7, wherein a permissible value of the print misregistration can be set on the inspection setting screen.

9. The setting apparatus according to claim 6, wherein a first print mode, and a second print mode in which an amount of a recording material used in the print processing is smaller compared to the first print mode, can be set on the print setting screen, the particular print setting is the first print mode, and the particular inspection setting corresponding to the particular print setting is a setting for inspecting whether the recording material has been appropriately used in the print processing.

10. The setting apparatus according to claim 6, wherein the control unit controls the display unit such that if the user is not permitted to set the particular inspection setting on the inspection setting screen, an item of the particular inspection setting is not displayed on the inspection setting screen.

11. The setting apparatus according to claim 6, wherein the display unit displays a setting screen which includes a plurality of tabs including at least a first tab and a second tab, the print setting screen is displayed in the first tab, and the inspection setting screen is displayed in the second tab.

12. An inspection system comprising:

a printing unit configured to perform print processing;

an inspection unit configured to perform inspection processing for inspecting a printed product on which has been performed the print processing;

a display unit configured to display a print setting screen for setting a print setting in the print processing and an inspection setting screen configured to set an inspection setting in the inspection processing; and a control unit configured to control, if a particular print setting is set on the print setting screen, the display unit such that the inspection setting screen is displayed in a state where an item corresponding to the particular print setting is registered as a target of the inspection processing.

13. An inspection system comprising:

a printing unit configured to perform print processing;

an inspection unit configured to perform inspection processing for inspecting a printed product on which has been performed the print processing;

a display unit configured to display a print setting screen for setting a print setting in the print processing and an inspection setting screen for setting an inspection setting in the inspection processing; and a control unit configured to perform control, if a particular print setting is set on the print setting screen, so that a user is permitted to set a particular inspection setting corresponding to the particular print setting on the inspection setting screen, and perform control, if the particular print setting is not set on the print setting screen, so that the user is not permitted to set the particular inspection setting on the inspection setting screen.

14. A setting method of inspection processing for inspecting a printed product on which has been performed print processing, the method comprising:

displaying a print setting screen for setting a print setting in the print processing and an inspection setting screen configured to set an inspection setting in the inspection processing, and if a particular print setting is set on the print setting screen, controlling such that the inspection setting screen is displayed in a state where an item corresponding to the particular print setting is registered as a target of the inspection processing.

15. A non-transitory computer-readable medium configured to cause a computer to execute a setting method of the inspection processing according to claim 14.

16. A setting method of inspection processing for inspecting a printed product on which has been performed print processing, the method comprising:

displaying a print setting screen for setting a print setting in the print processing and an inspection setting screen for setting an inspection setting in the inspection processing, and controlling, if a particular print setting is set on the print setting screen, so that a user is permitted to set a particular inspection setting corresponding to the particular print setting on the inspection setting screen, and controlling, if the particular print setting is not set on the print setting screen, so that the user is not permitted to set the particular inspection setting on the inspection setting screen.

17. A non-transitory computer-readable medium configured to cause a computer to execute the setting method of the inspection processing according to claim 16.

* * * * *